US005927161A

United States Patent [19]

Clifford et al.

[11] Patent Number: 5,927,161

[45] Date of Patent: Jul. 27, 1999

[54] ADJUSTABLE TOOL EXTENSION

[76] Inventors: Curwin A. Clifford, 81 Appleton Rd.; Errol G. Friedrich, 17 Washington St. #19, both of Auburn, Mass. 01501

[21] Appl. No.: 09/022,374

[22] Filed: Feb. 12, 1998

[51] Int. Cl.[6] ..... B25B 23/16

[52] U.S. Cl. ..... 81/177.2; 81/177.85

[58] Field of Search ..... 81/177.2, 177.85

[56] References Cited

U.S. PATENT DOCUMENTS

| | | | |
|---|---|---|---|
| 4,367,663 | 1/1983 | Merics | 81/177 |
| 4,905,548 | 3/1990 | Colace et al. | 81/177.2 |

FOREIGN PATENT DOCUMENTS

| | | |
|---|---|---|
| 506879 | 12/1919 | France . |
| 2058884 | 6/1972 | Germany . |

*Primary Examiner*—David A. Scherbel
*Assistant Examiner*—Philip J. Hoffmann

[57] ABSTRACT

An adjustable tool with multiple telescoping units. The upper member has a closed upper end, an open lower end, and a cylindrical sidewall therebetween. The closed upper end has a recess formed for receiving a drive end of a ratchet. An interior surface of the cylindrical wall has a plurality of diametrically opposed recesses extending a length. An intermediate member is telescopically received within the open lower end of the upper member. The intermediate member has an upper portion and a lower portion. The upper portion has a thickness less than a thickness of an interior of the upper member. The upper portion has a pair of diametrically opposed spring balls extending outwardly for selectively mating with a pair of recesses of the upper member. The lower portion has an open lower end and a hollow interior. An interior surface of the lower portion has a plurality of diametrically opposed recesses extending a length. A lower member is telescopically received within the open lower end of the lower portion of the intermediate member. The lower member has an upper portion with a thickness less than a thickness of an interior of the lower portion of the intermediate member. The upper portion has a pair of diametrically opposed spring balls extending outwardly for selectively mating with a pair of opposed recesses of the lower portion. A lower end of the lower member has a drive end.

2 Claims, 2 Drawing Sheets

ADJUSTABLE TOOL EXTENSION

BACKGROUND OF THE INVENTION

1. Field of the Invention

The present invention relates to tool extensions and more particularly pertains to a new adjustable tool extension for extending a length of a tool with multiple telescoping units.

2. Description of the Prior Art

The use of tool extensions is known in the prior art. More specifically, tool extensions heretofore devised and utilized are known to consist basically of familiar, expected and obvious structural configurations, notwithstanding the myriad of designs encompassed by the crowded prior art which have been developed for the fulfillment of countless objectives and requirements.

Known prior art tool extensions include U.S. Pat. No. 4,905,548 to Colace et al.; U.S. Pat. No. 5,138,911 to Lan; U.S. Pat. No. 4,856,388 to Freeman; U.S. Pat. No. 4,676,125 to Ardelean; U.S. Pat. No. 4,317,393 to Graffam; and U.S. Pat. No. Des. 353,756 to Graves.

While these devices fulfill their respective, particular objectives and requirements, the aforementioned patents do not disclose a new adjustable tool extension. The inventive device includes a cylindrical configuration. The upper member has a closed upper end, an open lower end, and a cylindrical side wall therebetween. The closed upper end has a recess formed therein for receiving a drive end of a ratchet therein. An interior surface of the cylindrical wall has a plurality of diametrically opposed recesses formed therein extending a length thereof in a spaced relationship. An intermediate member is telescopically received within the open lower end of the upper member. The intermediate member has and upper portion and a lower portion. The upper portion has a thickness less than a thickness of an interior of the upper member. The upper portion has a pair of diametrically opposed spring balls extending outwardly therefrom for selectively mating with a pair of diametrically opposed recesses of the upper member. The lower portion has an open lower end and a hollow interior. An interior surface of the lower portion has a plurality of diametrically opposed recesses formed therein extending a length thereof in a spaced relationship. A lower member is telescopically received within the open lower end of the lower portion of the intermediate member. The lower member has an upper portion with a thickness less than a thickness of an interior of the lower portion of the intermediate member. The upper portion has a pair of diametrically opposed spring balls extending outwardly therefrom for selectively mating with a pair of diametrically opposed recesses of the lower portion. A lower end of the lower member has a drive end disposed thereon.

In these respects, the adjustable tool extension according to the present invention substantially departs from the conventional concepts and designs of the prior art, and in so doing provides an apparatus primarily developed for the purpose of extending a length of a tool with multiple telescoping units.

SUMMARY OF THE INVENTION

In view of the foregoing disadvantages inherent in the known types of tool extensions now present in the prior art, the present invention provides a new adjustable tool extension construction wherein the same can be utilized for extending a length of a tool with multiple telescoping units.

The general purpose of the present invention, which will be described subsequently in greater detail, is to provide a new adjustable tool extension apparatus and method which has many of the advantages of the tool extensions mentioned heretofore and many novel features that result in a new adjustable tool extension which is not anticipated, rendered obvious, suggested, or even implied by any of the prior art tool extensions, either alone or in any combination thereof.

To attain this, the present invention generally comprises an upper member having a cylindrical configuration. The upper member has a closed upper end, an open lower end, and a cylindrical side wall therebetween. The closed upper end has a recess formed therein for receiving a drive end of a ratchet therein. An interior surface of the cylindrical wall has a hexagonal shape. The interior surface has a plurality of diametrically opposed recesses formed therein extending a length thereof in a spaced relationship. An intermediate member is telescopically received within the open lower end of the upper member. The intermediate member has and upper portion and a lower portion. The upper portion has a hexagonal configuration with a thickness less than a thickness of an interior of the upper member. The upper portion has a pair of diametrically opposed spring balls extending outwardly therefrom for selectively mating with a pair of diametrically opposed recesses of the upper member. The lower portion has an open lower end and a hollow interior. An interior surface of the lower portion has a hexagonal shape. The interior surface has a plurality of diametrically opposed recesses formed therein extending a length thereof in a spaced relationship. A lower member is telescopically received within the open lower end of the lower portion of the intermediate member. The lower member has an upper hexagonal portion with a thickness less than a thickness of an interior of the lower portion of the intermediate member. The upper hexagonal portion has a pair of diametrically opposed spring balls extending outwardly therefrom for selectively mating with a pair of diametrically opposed recesses of the lower portion. A lower end of the lower member has a drive end disposed thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable tool extension apparatus and method which has many of the advantages of the tool extensions mentioned heretofore and many novel features that result in a new adjustable tool extension which is not anticipated, rendered obvious, suggested, or even implied by any of the prior art tool extensions, either alone or in any combination thereof.

It is another object of the present invention to provide a new adjustable tool extension which may be easily and efficiently manufactured and marketed.

It is a further object of the present invention to provide a new adjustable tool extension which is of a durable and reliable construction.

An even further object of the present invention is to provide a new adjustable tool extension which is susceptible of a low cost of manufacture with regard to both materials and labor, and which accordingly is then susceptible of low prices of sale to the consuming public, thereby making such adjustable tool extension economically available to the buying public.

Still yet another object of the present invention is to provide a new adjustable tool extension which provides in the apparatuses and methods of the prior art some of the advantages thereof, while simultaneously overcoming some of the disadvantages normally associated therewith.

Still another object of the present invention is to provide a new adjustable tool extension for extending a length of a tool with multiple telescoping units.

Yet another object of the present invention is to provide a new adjustable tool extension which includes a cylindrical configuration. The upper member has a closed upper end, an open lower end, and a cylindrical side wall therebetween. The closed upper end has a recess formed therein for receiving a drive end of a ratchet therein. An interior surface of the cylindrical wall has a plurality of diametrically opposed recesses formed therein extending a length thereof in a spaced relationship. An intermediate member is telescopically received within the open lower end of the upper member. The intermediate member has and upper portion and a lower portion. The upper portion has a thickness less than a thickness of an interior of the upper member. The upper portion has a pair of diametrically opposed spring balls extending outwardly therefrom for selectively mating with a pair of diametrically opposed recesses of the upper member. The lower portion has an open lower end and a hollow interior. An interior surface of the lower portion has a plurality of diametrically opposed recesses formed therein extending a length thereof in a spaced relationship. A lower member is telescopically received within the open lower end of the lower portion of the intermediate member. The lower member has an upper portion with a thickness less than a thickness of an interior of the lower portion of the intermediate member. The upper portion has a pair of diametrically opposed spring balls extending outwardly therefrom for selectively mating with a pair of diametrically opposed recesses of the lower portion. A lower end of the lower member has a drive end disposed thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
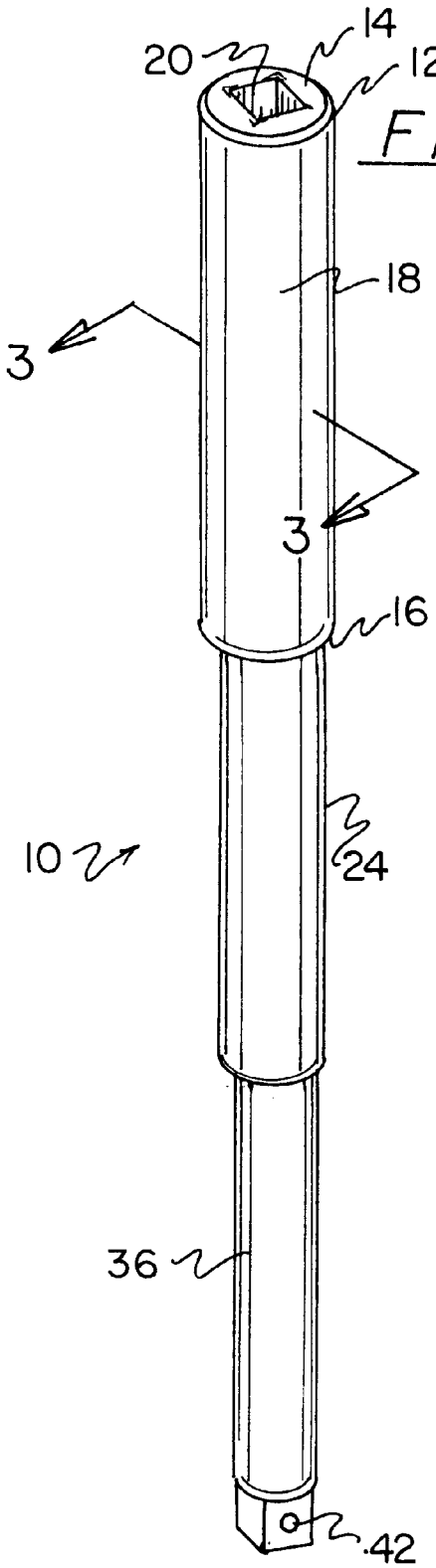
FIG. 1 is a perspective view of a new adjustable tool extension according to the present invention.
Figure 2:
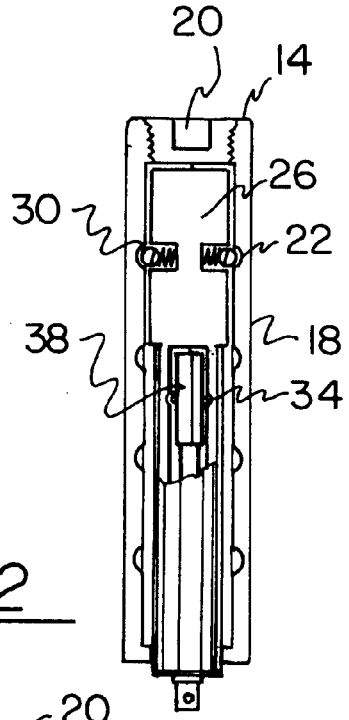
FIG. 2 is a cross-sectional view of the present invention illustrated in a collapsed orientation.
Figure 3:
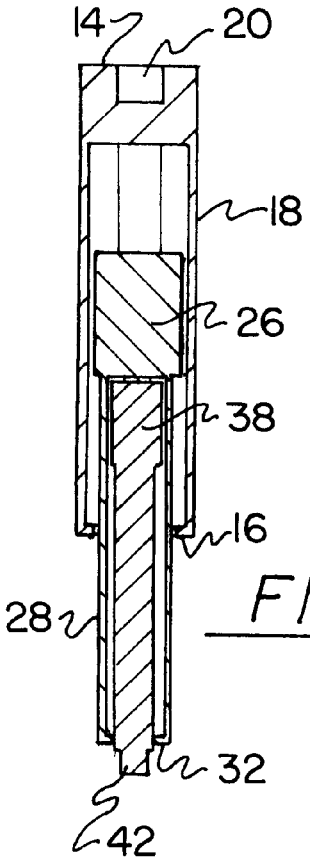
FIG. 3 is a cross-sectional view of the present invention as taken along line 3—3 of FIG. 1.
Figure 4:
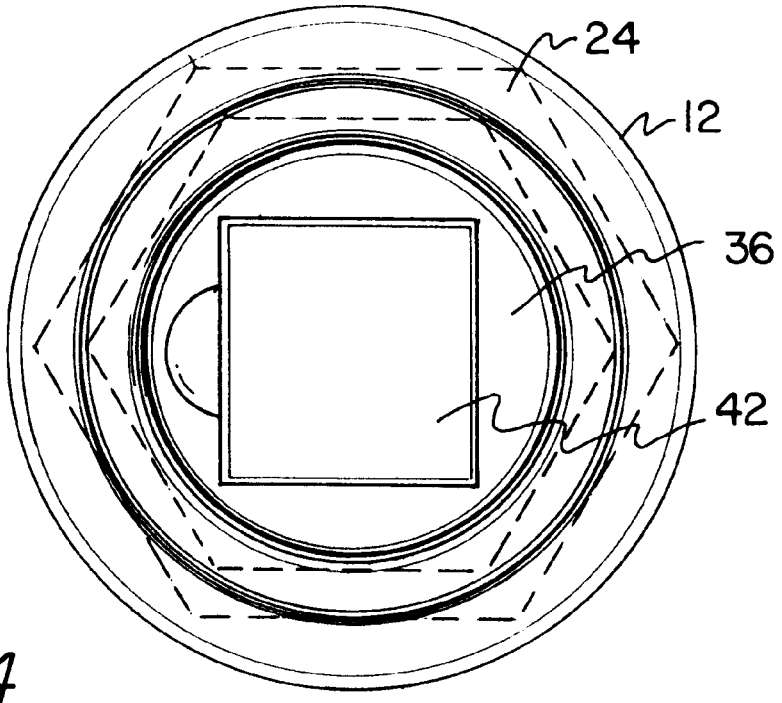
FIG. 4 is a bottom plan view of the present invention.
Figure 5:
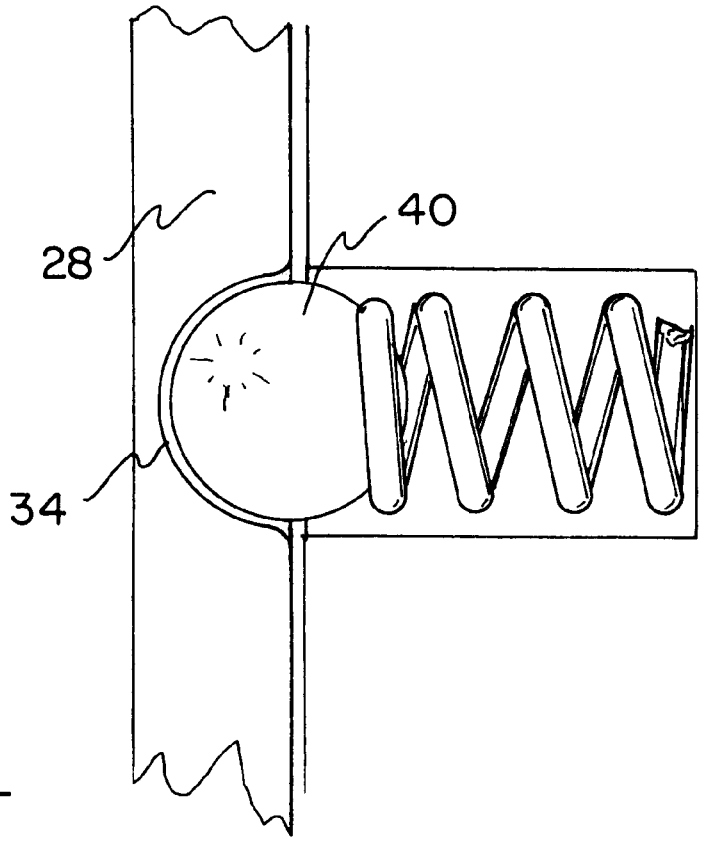
FIG. 5 is a front view of the present invention illustrating the spring balls thereof.

With reference now to the drawings, and in particular to FIGS. 1 through 5 thereof, a new adjustable tool extension embodying the principles and concepts of the present invention and generally designated by the reference numeral 10 will be described.

As best illustrated in FIGS. 1 through 5, the adjustable tool extension 10 comprises an upper member 12 having a cylindrical configuration. The upper member 12 has a closed upper end 14, an open lower end 16, and a cylindrical side wall 18 therebetween. The closed upper end 14 has a recess 20 formed therein for receiving a drive end of a ratchet therein. An interior surface of the cylindrical wall 18 has a hexagonal shape. The interior surface has a plurality of diametrically opposed recesses 22 formed therein extending a length thereof in a spaced relationship.

An intermediate member 24 is telescopically received within the open lower end 16 of the upper member 12. The intermediate member 24 has an upper portion 26 and a lower portion 28. The upper portion 26 has a hexagonal configuration with a thickness less than a thickness of an interior of the upper member 12. The upper portion 26 has a pair of diametrically opposed spring balls 30 extending outwardly therefrom for selectively mating with a pair of diametrically opposed recesses 22 of the upper member 12. The lower portion 28 has an open lower end 32 and a hollow interior. An interior surface of the lower portion 28 has a hexagonal shape. The interior surface has a plurality of diametrically opposed recesses 34 formed therein extending a length thereof in a spaced relationship.

A lower member 36 is telescopically received within the open lower end 32 of the lower portion 28 of the intermediate member 24. The lower member 36 has an upper hexagonal portion 38 with a thickness less than a thickness of an interior of the lower portion 28 of the intermediate member 24. The upper hexagonal portion 38 has a pair of diametrically opposed spring balls 40 extending outwardly therefrom for selectively mating with a pair of diametrically opposed recesses 34 of the lower portion 28. A lower end of the lower member 36 has a drive end 42 disposed thereon. The drive end 42 can be used to couple with various special fittings to allow for the attachment of a variety of tools.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A adjustable tool extension for extending a length of a tool with multiple telescoping units comprising, in combination:

an upper member having a cylindrical configuration, the upper member having a closed upper end, an open lower end, and a cylindrical side wall therebetween, the closed upper end having a recess formed therein for receiving a drive end of a ratchet therein, an interior surface of the cylindrical wall having a hexagonal shape, the open lower end having a collar defining a hexagonal opening, the opening having a diameter less than the smallest length across the interior surface, the interior surface having a plurality of diametrically opposed recesses formed therein extending a length thereof in a spaced relationship;

an intermediate member telescopically received in the interior of the open lower end of the upper member, the intermediate member having an upper portion and a lower portion, the upper portion having a hexagonal exterior surface adapted for snugly fitting in the open lower end of the upper member in a manner resisting rotation of the intermediate member relative to the upper member, the upper portion of the intermediate member having a thickness less than a thickness of an interior of the upper member but greater than the opening of the collar of the upper member, the upper portion having a pair of diametrically opposed spring balls extending outwardly therefrom for selectively mating with a pair of diametrically opposed recesses of the upper member, the lower portion having an open lower end and a hollow interior, an interior surface of the lower portion having a hexagonal shape, the open lower end having a collar defining a hexagonal opening, the opening having a diameter less than the smallest length across the hollow interior, the interior surface having a plurality of diametrically opposed recesses formed therein extending a length thereof in a spaced relationship; and a lower member telescopically received in the open lower end of the lower portion of the intermediate member, the lower member having an upper hexagonal portion with an exterior surface adapted for snugly fitting in the open lower end of the intermediate member in a manner resisting rotation of the lower member relative to the intermediate member, the upper portion of the lower member having a thickness less than a thickness of an interior of the lower portion of the intermediate member but greater than the opening of the collar of the intermediate member, the upper hexagonal portion having a pair of diametrically opposed spring balls extending outwardly therefrom for selectively mating with a pair of diametrically opposed recesses of the lower portion, a lower end of the lower member having a drive end disposed thereon.

2. A adjustable tool extension for extending a length of a tool with multiple telescoping units comprising, in combination:

an upper member having a cylindrical exterior configuration, the upper member having a closed upper end, an open lower end, and a cylindrical side wall therebetween, the closed upper end having a recess formed therein for receiving a drive end of a ratchet therein, the open lower end having a collar defining an opening, the opening having a diameter less than a length across an interior surface, the interior surface having a plurality of diametrically opposed recesses formed therein and extending along a length thereof in a spaced relationship;

an intermediate member telescopically received in the open lower end of the upper member, the intermediate member having an upper portion and a lower portion, the upper portion having a thickness less than a thickness of an interior of the upper member but greater than the opening of the collar of the upper member, the upper portion having a pair of diametrically opposed spring balls extending outwardly therefrom for selectively mating with a pair of diametrically opposed recesses of the upper member, the lower portion having an open lower end and a hollow interior, the open lower end having a collar defining an opening, the opening having a diameter less than the length across the hollow interior, an interior surface having a plurality of diametrically opposed recesses formed therein extending a length thereof in a spaced relationship; and a lower member telescopically received in the open lower end of the lower portion of the intermediate member, the lower member having an upper portion having a thickness less than a thickness of an interior of the lower portion of the intermediate member but greater than the opening of the collar of the intermediate member, the upper portion having a pair of diametrically opposed spring balls extending outwardly therefrom for selectively mating with a pair of diametrically opposed recesses of the lower portion, a lower end of the lower member having a drive end disposed thereon.

* * * * *